US008024824B1

(12) United States Patent
Westermann

(10) Patent No.: US 8,024,824 B1
(45) Date of Patent: Sep. 27, 2011

(54) PERSON LIFTING APPARATUS AND METHOD

(76) Inventor: Karl Westermann, Round Rock, TX (US)

( * ) Notice: Subject to any disclaimer, the term of this patent is extended or adjusted under 35 U.S.C. 154(b) by 0 days.

(21) Appl. No.: 12/861,711

(22) Filed: Aug. 23, 2010

Related U.S. Application Data

(63) Continuation-in-part of application No. 12/829,508, filed on Jul. 2, 2010, now abandoned.

(51) Int. Cl.
*A61G 7/10* (2006.01)

(52) U.S. Cl. ..... 5/85.1; 5/88.1; 297/DIG. 10

(58) Field of Classification Search ..... 5/81.1 R, 5/83.1, 85.1, 87.1, 88.1; 297/338, 339, 344.12, 297/DIG. 10; 254/4 R, 4 C
See application file for complete search history.

(56) References Cited

U.S. PATENT DOCUMENTS

| | | | | |
|---|---|---|---|---|
| 2,962,730 | A | 12/1960 | Carnes et al. | |
| 3,806,194 | A * | 4/1974 | Kolebaba | 297/344.19 |
| 3,829,916 | A | 8/1974 | James | |
| 3,938,820 | A * | 2/1976 | Nabinger | 280/47.11 |
| 4,633,538 | A | 1/1987 | James | |
| 4,920,590 | A | 5/1990 | Weiner | |
| 4,941,708 | A * | 7/1990 | Heffner | 297/6 |
| 5,090,072 | A * | 2/1992 | Gray | 5/87.1 |
| 5,421,639 | A | 6/1995 | Bartholomew | |
| 5,853,015 | A * | 12/1998 | Evans | 135/67 |
| 6,000,758 | A | 12/1999 | Schaffner et al. | |
| 6,467,785 | B2 | 10/2002 | Toppses | |
| 6,935,648 | B2 | 8/2005 | Beck | |
| 6,941,595 | B1 | 9/2005 | Michael | |
| 7,611,203 | B1 * | 11/2009 | Roberts et al. | 297/344.2 |
| 7,716,759 | B2 * | 5/2010 | Wilder | 5/83.1 |
| 2001/0040233 | A1 * | 11/2001 | Chamberlain | 254/4 R |
| 2008/0093176 | A1 | 4/2008 | Rosenthal | |

* cited by examiner

*Primary Examiner* — Michael Trettel
(74) *Attorney, Agent, or Firm* — Hulsey, P.C.; William N. Hulsey; John Temple Keller

(57) ABSTRACT

The present disclosure provides for individuals who may otherwise have trouble lifting themselves from the floor after a fall. Using the teachings of the present disclosure, such individuals may autonomously regain their footing, without the necessity of calling paramedics or others for help. An individual may crawl onto the seat of the device and then, using either a handcrank or an electric motor, lift himself to a sitting/standing position.

14 Claims, 11 Drawing Sheets

PERSON LIFTING APPARATUS AND METHOD

CROSS-REFERENCE TO RELATED APPLICATIONS

This application is a continuation-in-part of patent application Ser. No. 12/829,508, filed Jul. 2, 2010 now abandoned, which is hereby incorporated by reference for all purposes as if set forth fully herein.

FIELD

This disclosure relates generally to the field of devices designed for use by elderly, infirm, injured, handicapped, disabled, seizure-prone, or otherwise mobility-impaired individuals. More specifically, the present disclosure relates to individuals who may have trouble lifting themselves from the floor.

BACKGROUND

It is a known problem that elderly, infirm, injured, handicapped, disabled, seizure-prone, or otherwise mobility-impaired individuals may in some circumstances find themselves on the floor and unable to regain their footing.

This problem requires a technical solution for various reasons. An unassisted individual might or might not be able to pull himself up using furniture or fixtures in the home. A family member or friend might or might not be able to assist, if such a person is even available. Paramedics may be called, if a phone is accessible; but only at great expense and with significant delay.

One known apparatus for lifting a person from the ground comprises a chair seat attached to single vertical shaft as part of a metal frame resting on a pair of small wheels. The chair seat is lifted by a worm gear connected to either a handcrank or a motor at the top of the shaft. Various problems with this design are evident. For example, if the handcrank is to be used, the person sitting in the chair seat will not be able to actuate it on his own. It will require another person already standing. The way the chair seat attaches to only a single vertical shaft also increases the torque exerted on the drive train by the weight of the user. This may increase wear and make it more difficult to turn the handcrank. The chair seat of this apparatus also does not lower all the way to the floor, which makes it more difficult for the user to sit down. The wheeled design of this apparatus allows it to move with relative ease over a hard floor, but the bulky nature may make it difficult for a person of advanced age or other disability to move the device, particularly on carpet.

Another known device is essentially a standard wheelchair with two large rear wheels and two small front wheels, wherein the seat is able to move vertically under the power of a rechargeable battery. One problem with this device is its large size and weight, which may make it cumbersome to move and lift for a person of advanced age or other disability. Another problem is that its seat may not be able to lower all the way to become flush with the floor, increasing the difficulty of mounting the device. Yet another problem is that by relying solely on a rechargeable battery, this device may be inoperable at the time it is most needed. Yet another problem is that this device may not be able to lift its user high enough for an easy transition from a sitting position to a standing position. Yet another problem is that, being on wheels, the device may be prone to movement when a user is trying to climb onto the seat.

These and other problems are present in known prior art designs having to do with the subject matter of the present disclosure.

SUMMARY

Therefore, a need has arisen for a way for elderly, infirm, injured, handicapped, disabled, seizure-prone, or otherwise mobility-impaired individuals to autonomously regain their footing after suffering a fall, seizure, or other event that has left them on the floor.

According to the present disclosure, such an individual may quickly, easily, and without help from others lift himself from the floor to a sitting and/or a standing position. The devices of the present disclosure include a seat that is near or flush with the level of the floor, so that the individual may crawl to the device and sit on the seat. He may then cause the seat to lift to essentially the height of a chair or higher, from which he may then stand up and regain his footing. The lifting of the seat may be accomplished, in various embodiments, by either a manual handcrank or an electric motor.

The devices of the present disclosure may also be made of lightweight materials (for example, aluminum, steel, plastics, carbon fiber, etc.), such that they may be easily transported. Some particularly lightweight embodiments may be lifted and moved with a single hand, even by a person of advanced age or disability. This is an advantage because when a person has fallen down, a friend or family member may easily lift the device and bring it to him.

The dimensions of the disclosed devices also allow for easy storage. One embodiment has dimensions (when the seat is lowered and the stabilizing members are folded in) of approximately 42 inches in height, 36 inches in width, and 6 inches in thickness. This allows easy storage, for example in a closet, when the device is not in use.

By using the devices of the present disclosure, such an individual may avoid the disadvantages of known methods for rising after a fall.

These and other advantages of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with skill in the art upon examination of the following FIGURES and detailed description. It is intended that all such additional systems, methods, features and advantages included within this description, be within the scope of the claims.

BRIEF DESCRIPTION OF THE DRAWINGS

The features, nature, and advantages of the disclosed subject matter will become more apparent from the detailed description set forth below when taken in conjunction with the accompanying drawings, wherein.

DETAILED DESCRIPTION

Although described with reference to specific embodiments, one of ordinary skill in the art could apply the principles discussed herein to other areas and/or embodiments.

Those with skill in the art will recognize that the disclosed embodiments have relevance to a wide variety of areas in addition to those specific examples described below.

Figure 1:
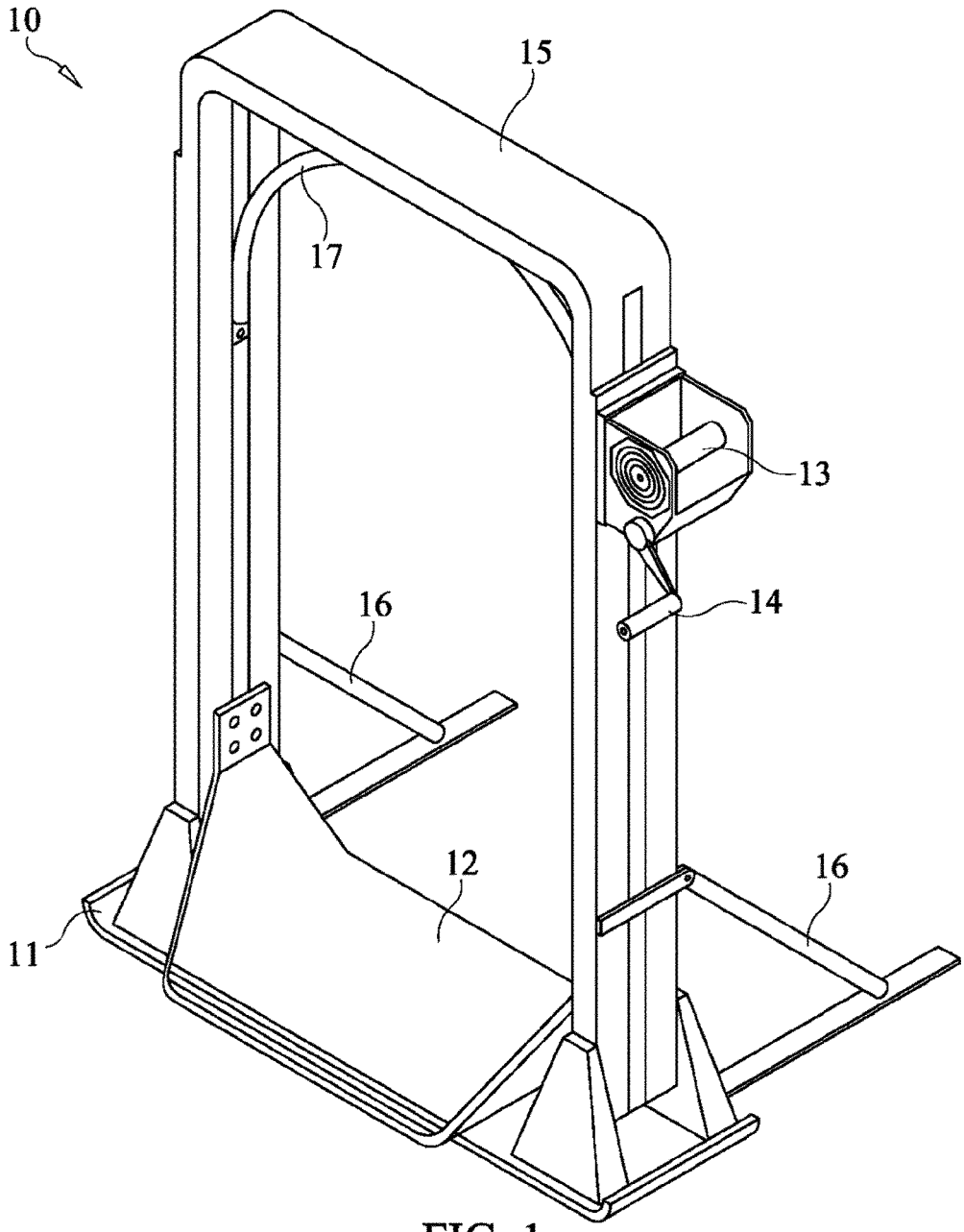
FIG. 1 shows an isometric view of an embodiment of the present disclosure in its lowered state.

FIG. 1 shows a view of lifter 10, an embodiment of the present disclosure. Lifter 10 rests on base 11. To use the device, a user who has fallen may crawl over and seat himself on seat 12. Seat 12 may, in some embodiments, have an indentation running along its length to prevent the user from slipping off during operation. Seat 12 may also in some embodiments taper down to be level with the floor, for easier accessibility. A safety belt (not shown) could also be included in order to ensure that the user of the device remains secure in the seat. The user may then manually turn handcrank 14.

Handcrank 14 is beneficial for several reasons. Electrical motors make the device easier to use, but in situations where electrical power is unavailable, the ability to still use the device is important. Battery-powered embodiments are possible, but a battery may be discharged at the moment when the device is needed. One preferred embodiment uses both a handcrank and a battery-powered motor, with a mechanism for switching between them. One embodiment of this type of mechanism is shown in more detail in FIG. 10.

Handcrank 14 may be geared down appropriately to allow it to turn easily. As discussed in more detail below, a worm gear arrangement may be beneficial. The gear ratio may be such that a person of advanced age or with a disability can easily turn the handle while lifting his entire weight. Handcrank 14 (or a motor, if used, as discussed in more detail below) may further include a ratcheting mechanism to allow it to raise the seat when torque is applied, but not allow the seat to fall when torque is not applied. In one embodiment, handcrank 14 may operate by winding a belt (not shown) onto spool 13. This belt may pass underneath seat 12, so that tensioning the belt causes seat 12 to rise.

Lifter 10 also includes support structure 15, which is coupled to seat 12 and is lifted along with it. Support structure 15 may also include a curved portion adapted for the user to hold onto, such as bar 17. Bar 17 may also increase the structural soundness of the overall device.

For stability, the lifter of the present disclosure may include stabilizing members 16, which may be attached to base 11, support structure 15, or both. In lifter 10, they are shown as comprising two separate pieces that may fold out from different places. The horizontal parts of stabilizing members 16 may fold out from base 11, and the diagonal parts may fold down from a vertical position in which they are attached to the frame of lifter 10. This configuration allows for compactness and stability, but one of ordinary skill will recognize that many other configurations are possible without departing from the scope of the present disclosure. Some embodiments of the present disclosure may also have stabilizing members that extend perpendicularly to stabilizing members 16.

Stabilizing members 16 may also be omitted, as shown in some of the other FIGURES. If they are omitted, the lifter may be instead affixed permanently or removably to a rigid structure, such as a wall, floor, ceiling, desk, or any other surface capable of stabilizing the weight of the lifter and the user. Means for affixing the lifter to such a surface may include, but are not limited to, nails, screws, bolts, staples, rivets, glue, magnets, and other types of affixing hardware known in the art.

Figure 11A:
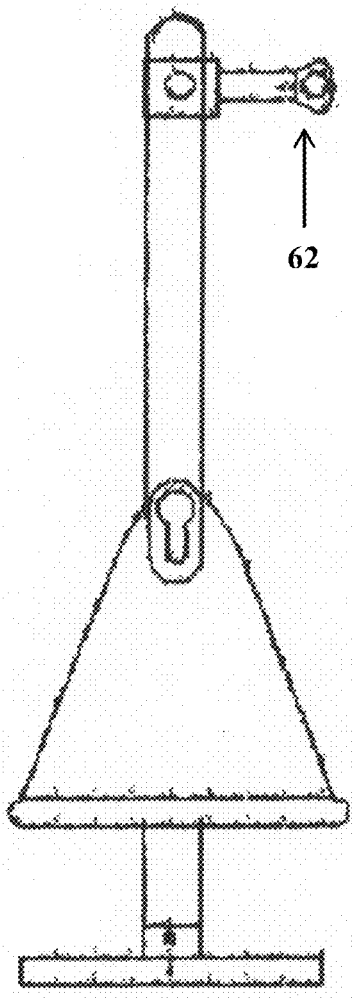
FIGS. 11A and 11B show a side view of an embodiment of the present disclosure including wall stand-offs.
Figure 11B:
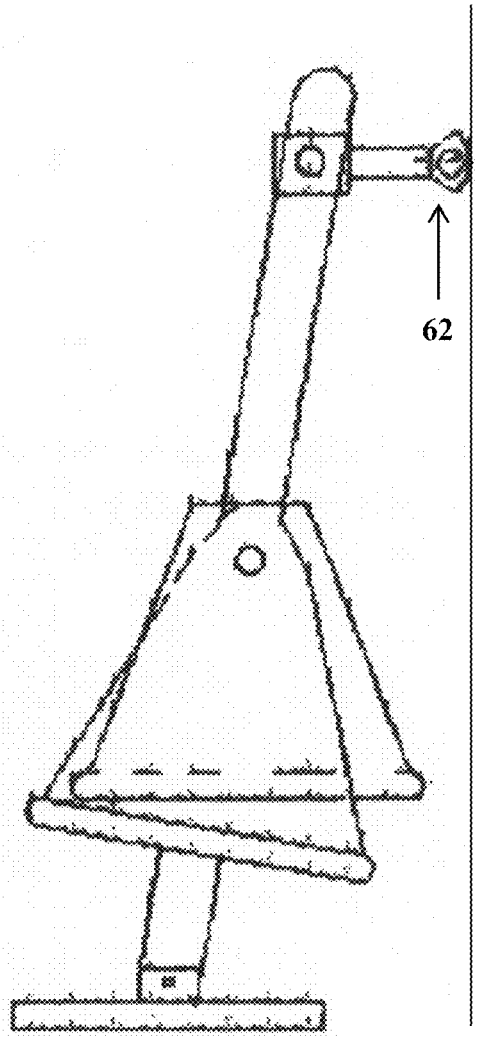

Another option for a wall-supported lifter is shown in FIGS. 11A and 11B. These figures depict a side view of a lifter in accordance with the present disclosure, including wall stand-offs 62. FIG. 11A shows the lifter in a vertical position, without any loading. FIG. 11B shows the same lifter, under the strain of some load (not shown), which has caused it to lean toward the wall. Wall stand-offs 62 have prevented the lifter from tipping over, allowing it to rest harmlessly against the wall.

The lifter may also be used to lift heavy objects. This feature may be advantageous to the people who would use the devices of the present disclosure, as those people may tend to be advanced in age and have difficulty lifting heavy objects. To this end, optional cargo lashings (not shown) could be included for affixing cargo to the seat of the disclosed devices. Alternatively, the seat may be made removable and interchangeable with a cargo-supporting platform, which may or may not include cargo lashings.

Figure 2:
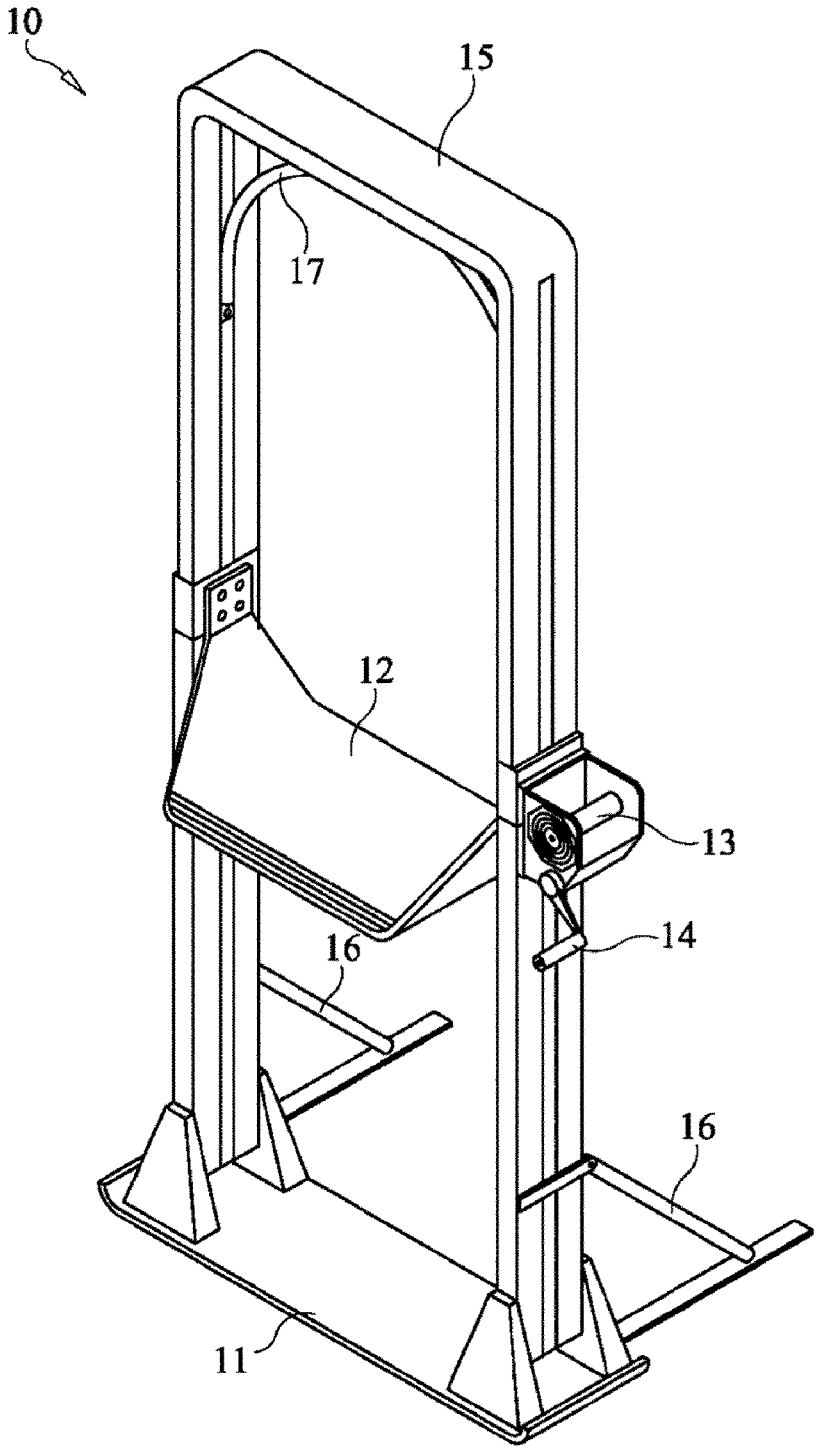
FIG. 2 shows an isometric view of an embodiment of the present disclosure in its raised state.

FIG. 2 depicts the lifter of FIG. 1 in its raised state. From this height, a user could easily reach a standing position. Alternatively, an assistant could move a wheelchair into position behind the lifter, and then the user could be lowered into the wheelchair by lowering the seat of the lifter. As shown, support structure 15 and seat 12 remain at a fixed distance from one another as the lifter is raised. This arrangement, in which support structure 15 raises in conjunction with seat 12 allows the user to sit comfortably within the device while lifting himself.

Figure 3:
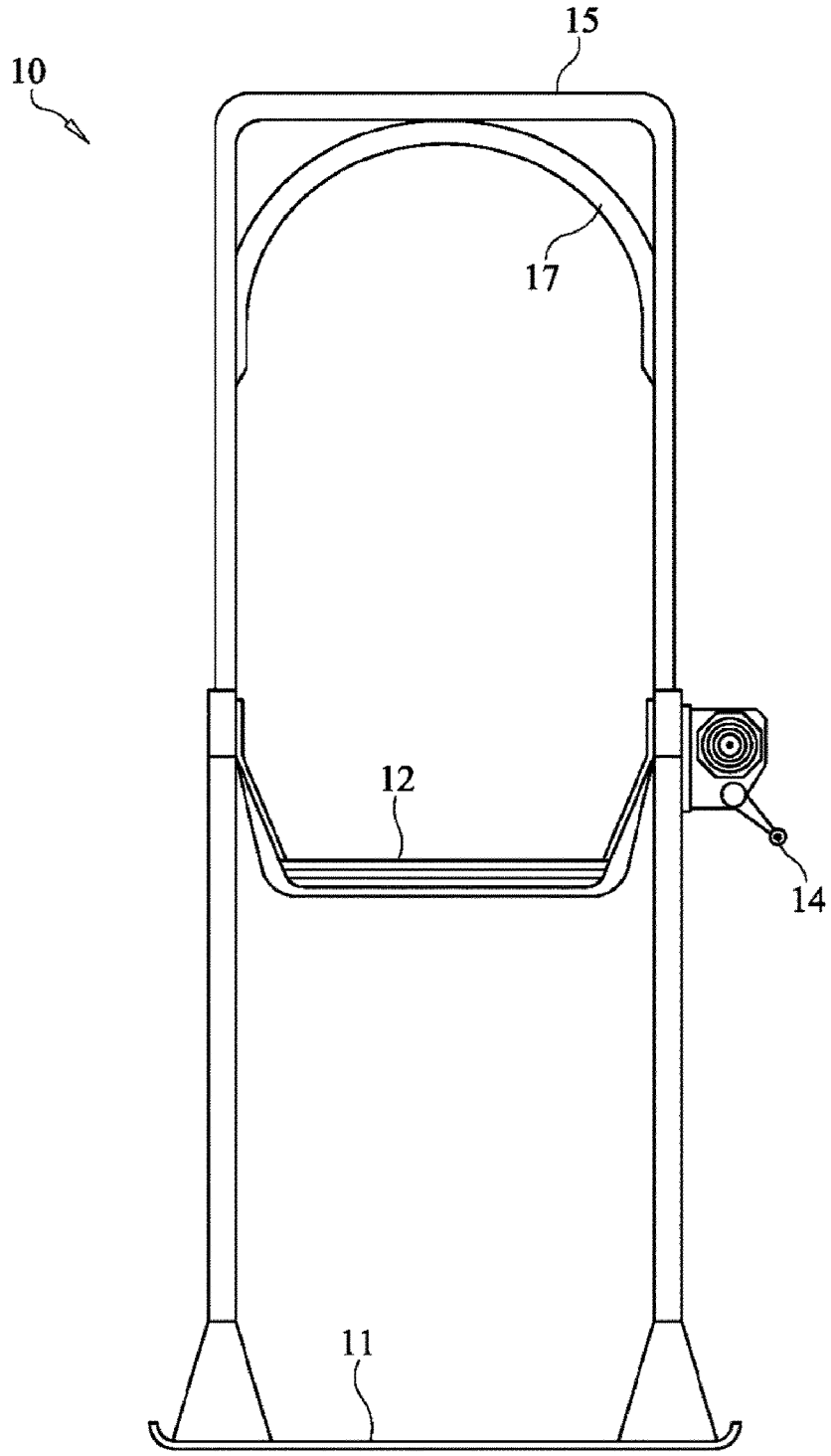
FIG. 3 shows a front view of an embodiment of the present disclosure in its raised state.

FIG. 3 presents a front view of the arrangement shown in FIG. 2. Note that seat 12 is wide enough to accommodate even a large user, but that the entire device is still narrow enough to fit through doorways easily or even be set up within a doorway. The horizontal sections of stabilizing members 16 (not shown) may be folded underneath or into base 11.

Figure 4:
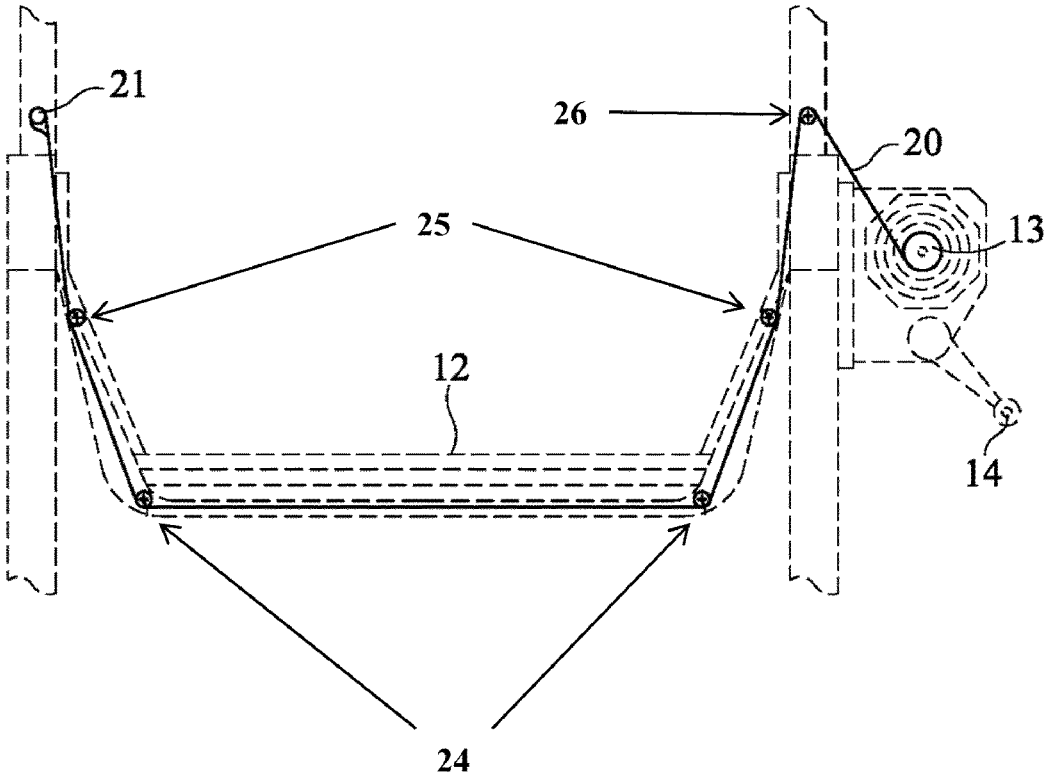
FIG. 4 shows a front detail view of an embodiment of the present disclosure.

The exact details of the mechanism by which handcrank 14 lifts seat 12 and support structure 15 are not essential aspects of the present disclosure, but one possible embodiment is shown in the detail view presented in FIG. 4. In this embodiment, strap 20 is fixed to anchor 21, passes underneath seat 12 and across side rollers 25, bottom rollers 24, and top roller 26, and is then wound around spool 13 as handcrank 14 is turned. As strap 20 is wound around spool 13, it causes seat 12 and the accompanying support structure 15 to rise. As shown, bottom rollers 24 may in some embodiments be recessed into seat 12, in order to allow seat 12 to lower all the way flush to the floor. The arrangement shown allows the bulk of the weight to be carried by bottom rollers 24, with some weight shared by side rollers 25. Having the rollers directly under seat 12 may prevent seat 12 being flush with the floor. Rollers 24, 25, and 26 may have flanges at their ends in order to guide strap 20 and prevent it from slipping out of the path. A sheath or channel in the bottom of seat 12 for holding strap 20 in place and preventing tangling may also be used. Strap 20 may be made of any suitable material that is sufficiently strong to support the weight of the user. In some embodiments, it may be advantageous to use a material similar to the textile used in making automobile seatbelts. Such a material exhibits very high tensile strength, while being adapted to easily slide over the contact surfaces in the lifter of the present disclosure. Other embodiments may use a cable, a rope, a belt, a piece of nylon, cloth, fabric, or any other reasonably high-strength non-rigid material. All of these embodiments will be referred to generically herein as a "strap."

Figure 9:
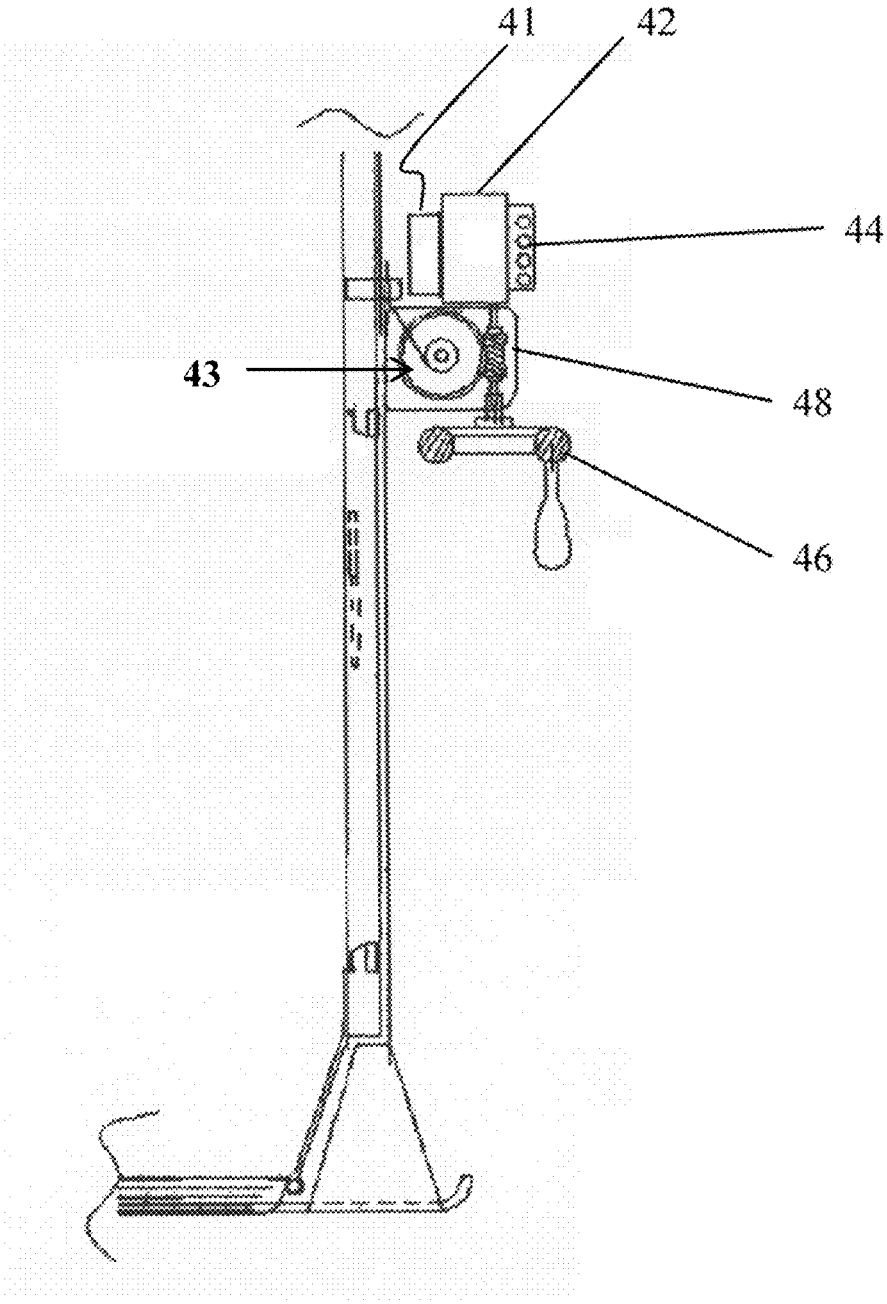
FIG. 9 shows a detail view of an embodiment of the present disclosure.

FIG. 9 shows another possible embodiment of the interface between the motor/handcrank and the strap. This embodiment includes handcrank 46 as well as motor 42. Motor 42 is optional. Power in this embodiment comes from battery 41, eliminating the danger of tripping over a power cord. Motor 42 is controlled by detachable remote control 44, show in this FIGURE in its docked position alongside motor 42. Handcrank 46 may be disengaged from the rest of the machinery when motor 42 is in use to prevent it from spinning and possibly causing a hazard. As shown, power is transferred via worm gear 48 to the spool via spool gear 43. This winds up the strap, lifting the seat (not shown).

Figure 10:
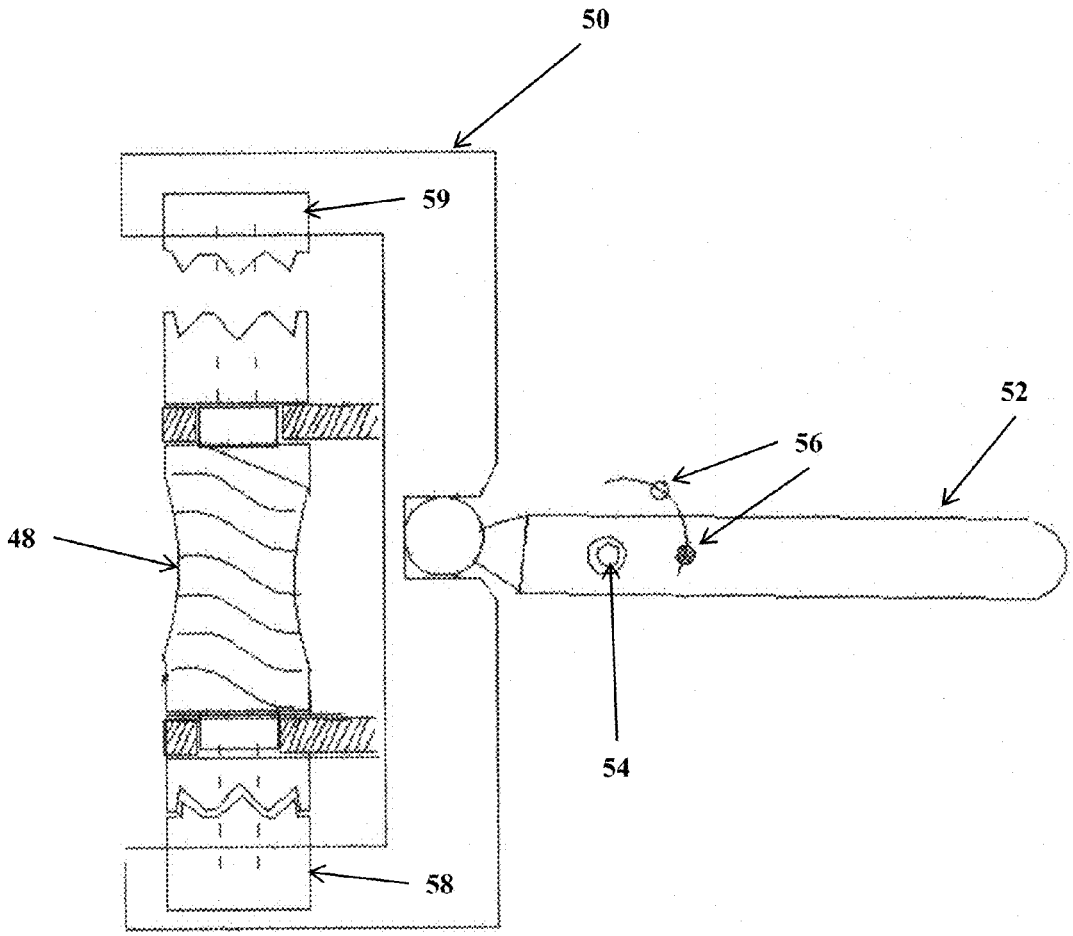
FIG. 10 shows a detail view of a worm gear assembly and enclosure in accordance with the present disclosure.

FIG. 10 shows a detail view of the worm gear assembly shown in FIG. 9. Worm gear 48 and spool gear 43 (not shown) are at a fixed vertical position relative to the rest of the device. Housing 50 may be moved to either of two vertical positions by handle 52, which rotates about pivot 54. In the embodiment shown, handle 52 contains a spring-loaded ball, which fits into either of detents 56 and is thereby locked into position. Handcrank 46 is connected to shaft 58, and motor 42 is connected to shaft 59. By moving lever 52, the user may select either handcrank 46 or motor 42 (but not both) to interface with worm gear 48 and power the lifting. In this way, when motor 42 is used, handcrank 48 is prevented from spinning; and when handcrank 48 is used, motor 42 is not forced to turn. As shown, handle 52 is in the "down" position, putting housing 50 into the "up" position and allowing the device to be powered manually by handcrank 48.

Figure 5:
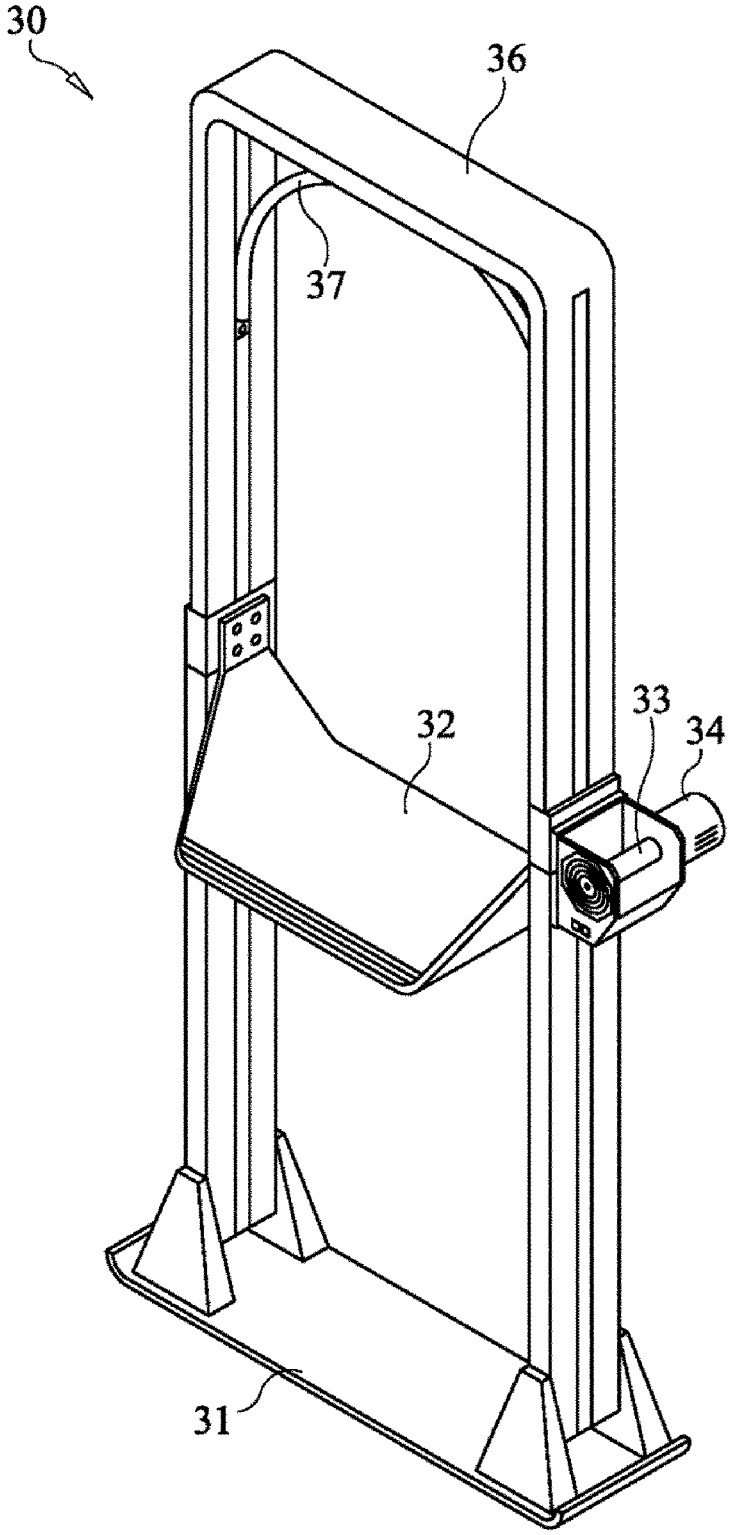
FIG. 5 shows an isometric view of an embodiment of the present disclosure having an electric motor.

FIG. 5 shows an embodiment of lifter 30 of the present disclosure using an electric motor in place of a handcrank. As above, spool 33 winds a strap (not shown), which lifts seat 32 and support structure 36. And as above, the strap arrangement could be replaced with a direct-drive system or any other way of translating the rotary motion of motor 34 into linear motion in the lifter.

One advantage of using a motor instead of a handcrank is that it may be designed to stop at a height appropriate for a given user, by using a limit switch or other cutoff mechanism. Such a limit switch may be advantageous in the common case where only a single user frequently uses the lifter. When more than one user frequently uses the lifter, a single limit switch may be inadequate to satisfy differing height needs.

Motor 34 is shown in this embodiment as having a battery power supply. In other embodiments, a power cord could be used, but this may be disadvantageous as it increases the risk of tripping and decreases portability.

The switch used for activating motor 34 may be of any suitable type. In some embodiments, a SPCO (single pole, center off) switch may be used. In this embodiment, the motor 34 runs in one direction when the switch is in its first position, motor 34 is off when the switch is in its second position, and motor runs in the opposite direction when the switch is in its third position. Using a switch with an off position between the two on positions may reduce the likelihood of unintentionally reversing direction.

Lifter 30 omits stabilizing members, but they could be included as shown above. Alternatively, lifter 30 could simply be affixed to some suitable surface for stability.

Figure 6:
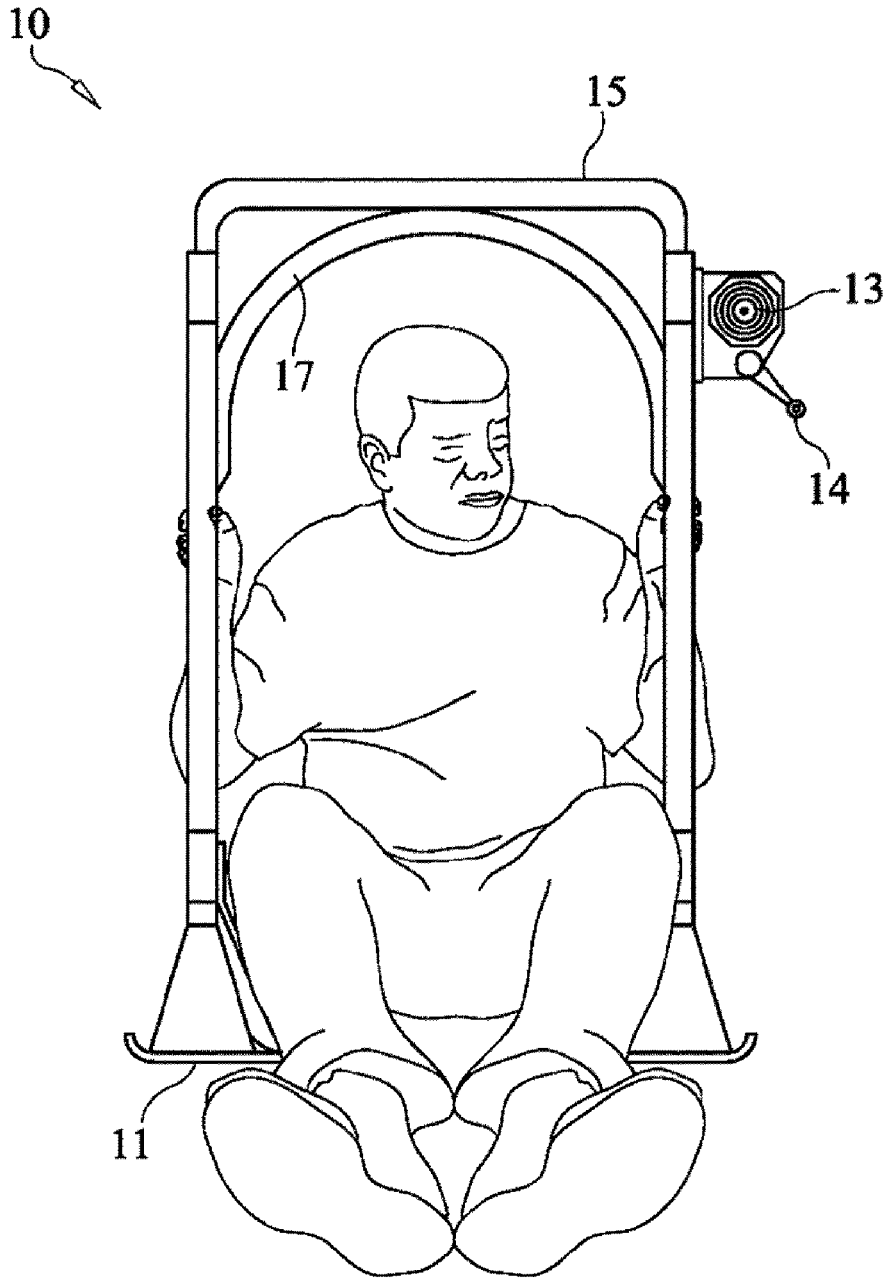
FIG. 6 shows a front view of a user sitting on an embodiment of the present disclosure in its lowered state.
Figure 7:
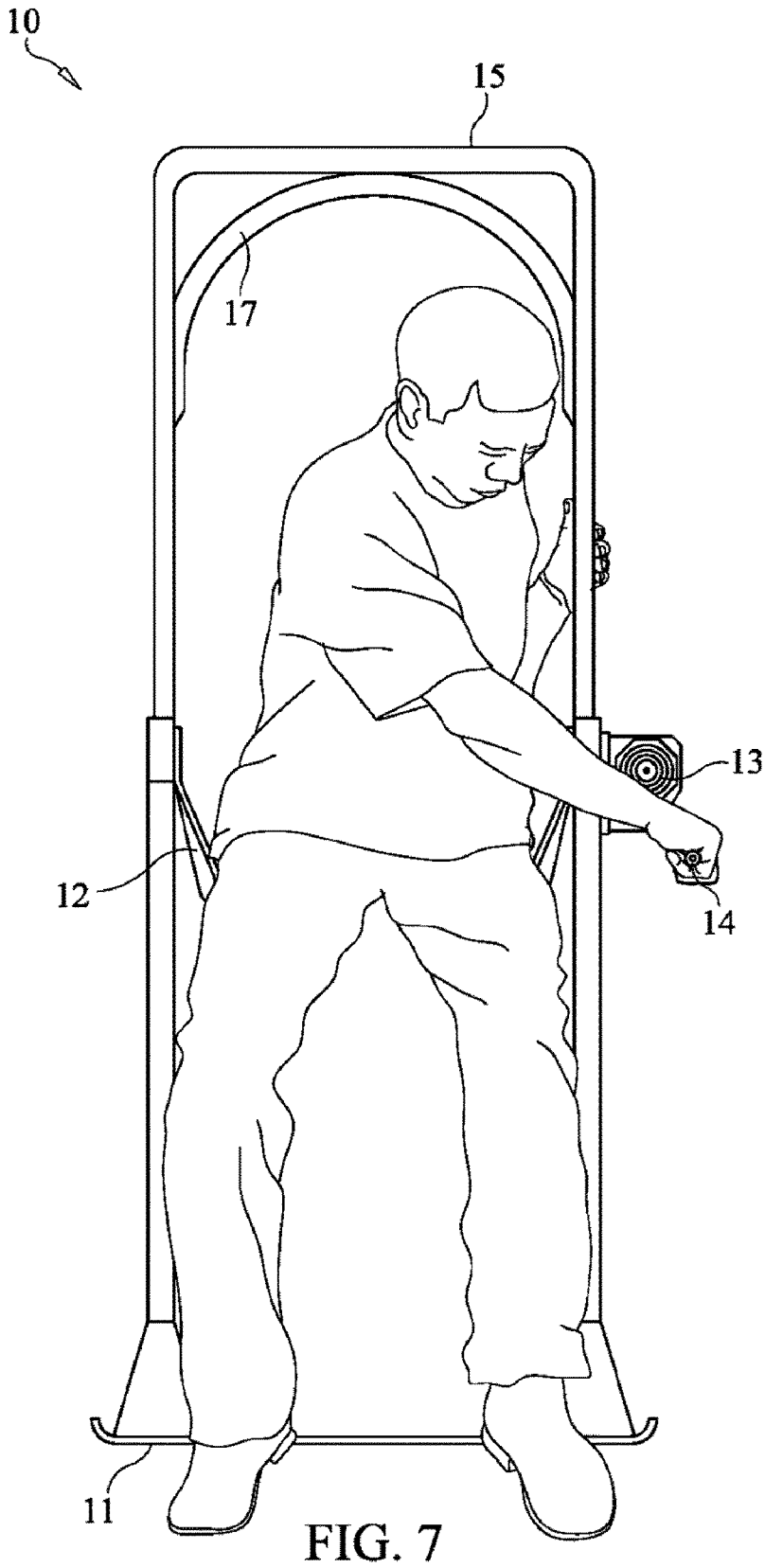
FIG. 7 shows a front view of a user using an embodiment of the present disclosure in its raised state.
Figure 8:
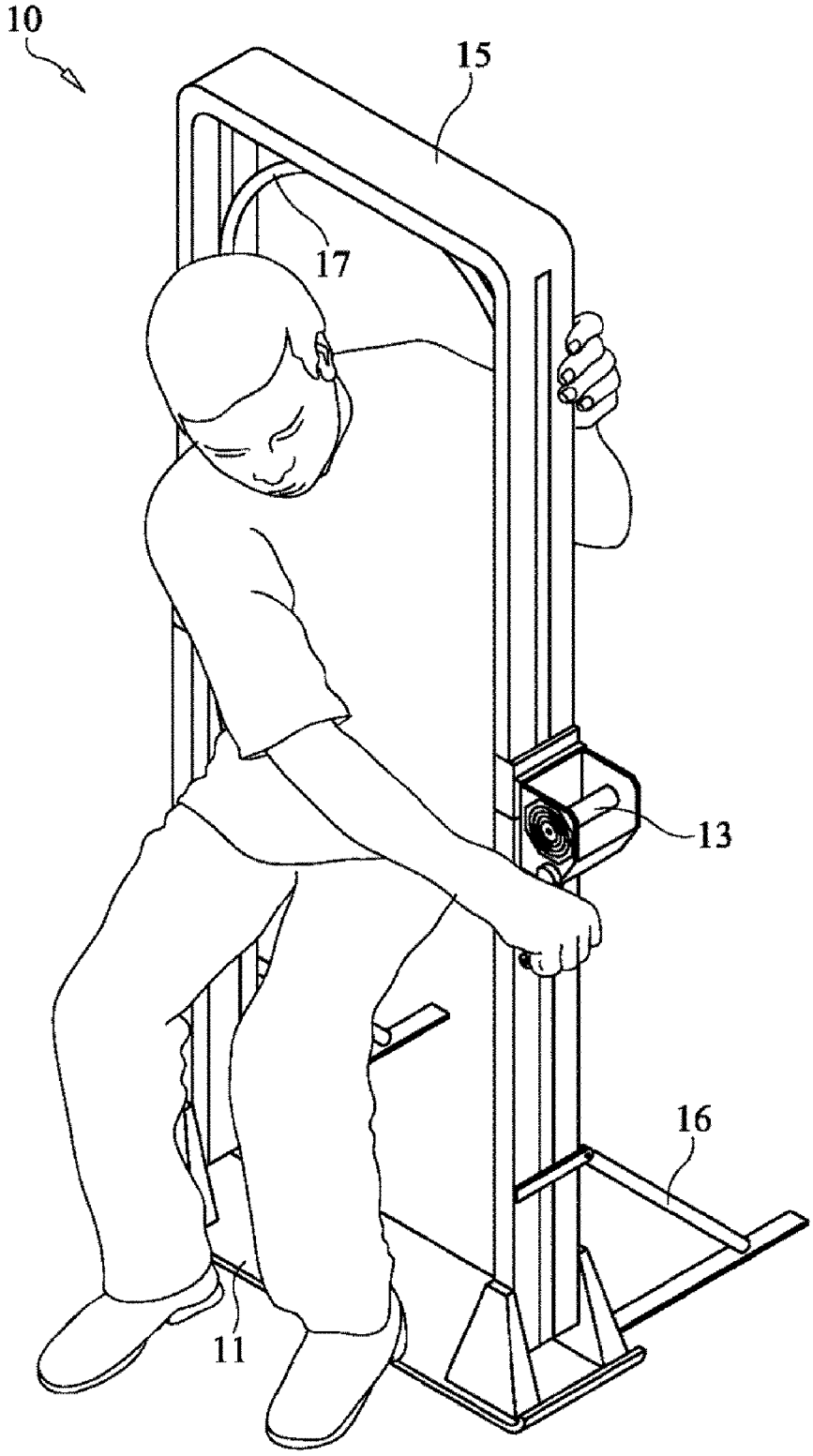
FIG. 8 shows an isometric view of a user using an embodiment of the present disclosure in its raised state.

FIG. 6 shows a user sitting on lifter 10 in its lowered position. FIG. 7 shows that user after he has used handcrank 14 to lift himself to a sitting position, from which he may then regain his footing. And FIG. 8 shows an isometric view of the embodiment shown in FIG. 7.

The foregoing description of the exemplary embodiments is provided to enable any person skilled in the art to make and use the subject matter. Various modifications to these embodiments will be readily apparent to those skilled in the art, and the generic principles defined herein may be applied to other embodiments without the use of the innovative faculty. Thus, the subject matter claimed is not intended to be limited to the embodiments shown herein but is to be accorded the widest scope consistent with the principles and novel features disclosed herein.

It is intended that all such additional systems, methods, features and advantages that are included within this description, be within the scope of the claims.

What is claimed is:

1. An apparatus for lifting a user from a floor to a sitting position, said apparatus comprising:

a base;

at least two fixed vertical members coupled to said base;

a seat coupled to said at least two fixed vertical members and suspended between said at least two fixed vertical members via a strap, wherein said strap is capable of moving said seat vertically relative to said at least two fixed vertical members from a lower position to an elevated position, wherein in said lower position said seat is within one inch of the floor;

a support structure coupled to said seat, said support structure comprising at least a curved member disposed above said seat and operable as a hand hold; and a handcrank capable of moving said seat and said support structure from said lower position to said elevated position.

2. The apparatus of claim 1, further comprising at least one stabilizing member coupled to said base.

3. The apparatus of claim 2, wherein said at least one stabilizing member is movably coupled to said base.

4. The apparatus of claim 1, wherein the apparatus is coupled to a rigid surface, said rigid surface capable of supporting the apparatus and the user.

5. The apparatus of claim 1, wherein in said lower position said seat is in contact with said floor.

6. The apparatus of claim 1, wherein said handcrank comprises teeth coupled to said support structure.

7. An apparatus for lifting a user from a floor to a sitting position, said apparatus comprising:

a base;

at least two fixed vertical members coupled to said base;

a seat coupled to said at least two fixed vertical members and suspended between said at least two fixed vertical members via a strap, wherein said strap is capable of moving said seat vertically relative to said at least two fixed vertical members from a lower position to an elevated position, wherein in said lower position said seat is within one inch of the floor;

a support structure coupled to said seat, said support structure comprising at least a curved member disposed above said seat and operable as a hand hold; and a motor capable of moving said seat and said support structure from said lower position to said elevated position.

8. The apparatus of claim 7, further comprising at least one stabilizing member coupled to said base.

9. The apparatus of claim 8, wherein said at least one stabilizing member is movably coupled to said base.

10. The apparatus of claim 7, wherein the apparatus is coupled to a rigid surface, said rigid surface capable of supporting the apparatus and the user.

11. The apparatus of claim 7, wherein in said lower position said seat is in contact with said floor.

12. The apparatus of claim 7, wherein said motor comprises teeth coupled to said support structure.

13. The apparatus of claim 7, further comprising a limit switch for stopping said seat at a predetermined height.

14. An apparatus for lifting a user from a floor to a sitting position, said apparatus comprising:

a base;

at least two fixed vertical members coupled to said base;

at least two stabilizing members movably coupled to said base and coupled to at least one of said vertical members;

a seat coupled to said at least two fixed vertical members and suspended between said at least two fixed vertical members via a strap, wherein said strap is capable of moving said seat vertically relative to said at least two fixed vertical members from a lower position to an elevated position, wherein in said lower position said seat is in contact with said floor;

a support structure coupled to said seat, said support structure comprising at least a curved member disposed above said seat and operable as a hand hold; and a handcrank capable of moving said seat and said support structure from said lower position to said elevated position, said handcrank comprising at least two gears, wherein said handcrank is capable of winding a strap onto a spool, said strap being coupled to said seat.

* * * * *